United States Patent [19]

Richart et al.

[11] Patent Number: 4,689,241

[45] Date of Patent: Aug. 25, 1987

[54] METHOD FOR POWDER COATING WITH ELECTROSTATIC FLUIDIZED BED

[76] Inventors: Douglas S. Richart, 8 Upland Rd., Wyomissing; Paul R. Horinka, Jr., 208 Amherst Ave., Reading, both of Pa. 19609

[21] Appl. No.: 829,628

[22] Filed: Feb. 14, 1986

[51] Int. Cl.[4] ..... B05D 7/22; B05D 1/24

[52] U.S. Cl. ..... 427/28; 427/182; 427/185

[58] Field of Search ..... 427/25, 27, 185, 29, 427/28, 182

[56] References Cited

U.S. PATENT DOCUMENTS 4,154,871 5/1979 White et al. ..... 427/27

OTHER PUBLICATIONS

"Webster's Ninth New Collegiate Dictionary", Springfield, MA, Merriam-Webster Inc., 1986, p. 620.

*Primary Examiner*—Evan K. Lawrence

*Attorney, Agent, or Firm*—Wayne E. Nacker; Gerald K. White

[57] ABSTRACT

Significant improvements in the coating characteristics of electrostatic fluidized beds are obtained by limiting the weight of the fines in the coating powder to certain maximum levels, e.g., no more than 10% by weight of minus 38 micrometer particles. The improvements include faster build rates, higher deposition weights, and deeper penetration into holes, slots or other cavities of the substrate.

3 Claims, 1 Drawing Figure

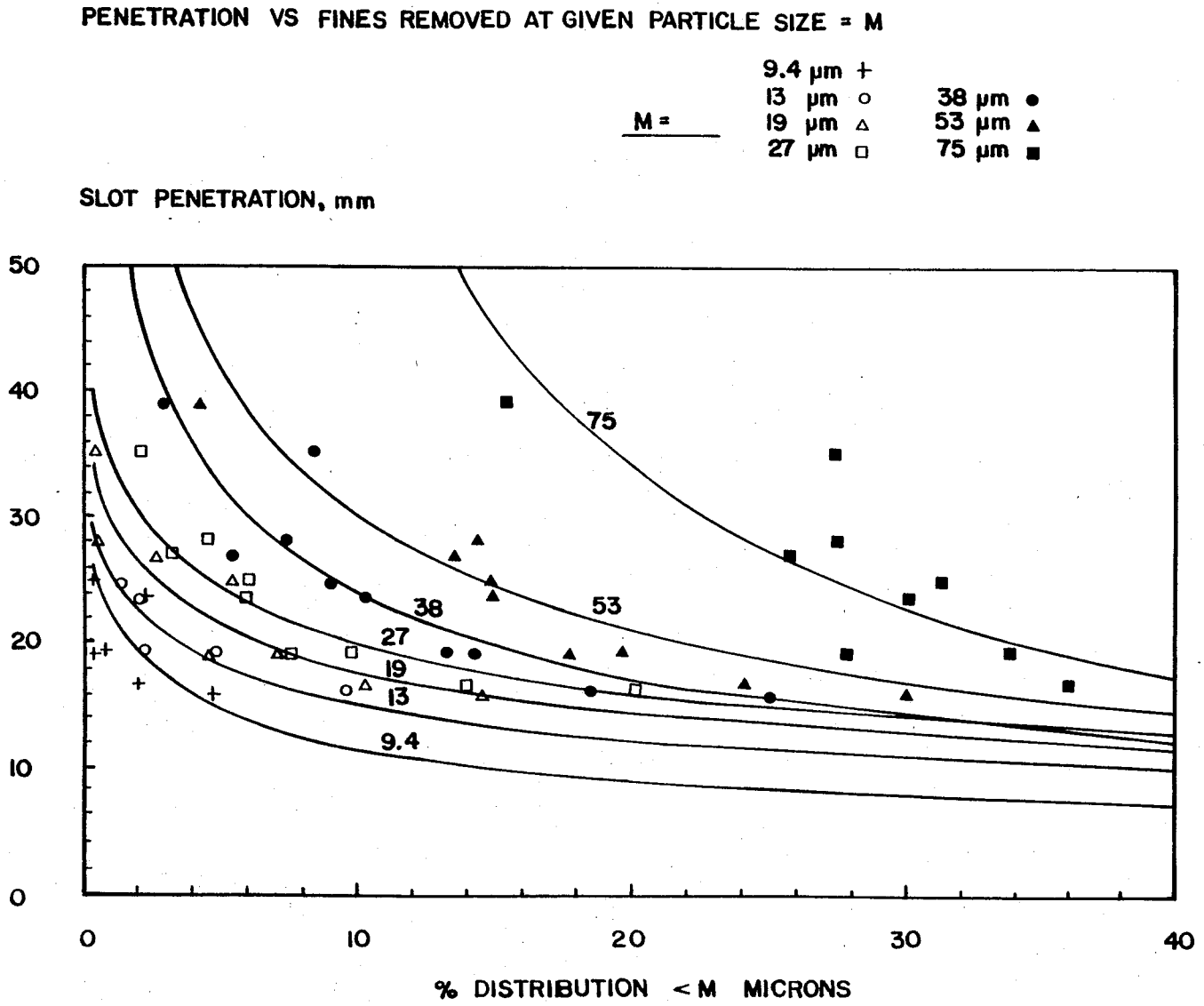
PENETRATION VS FINES REMOVED AT GIVEN PARTICLE SIZE = M
M =
9.4 µm +
13 µm ○
19 µm △
27 µm □
38 µm ●
53 µm ▲
75 µm ■
SLOT PENETRATION, mm
% DISTRIBUTION < M MICRONS
75
53
38
27
19
13
9.4
0
10
20
30
40
50

METHOD FOR POWDER COATING WITH ELECTROSTATIC FLUIDIZED BED

BACKGROUND OF THE INVENTION

This invention relates to coating techniques utilizing electrostatic fluidized beds and, more particularly, to the penetration of coating powders into holes, slots or other cavities in the substrate and the rate at which the powdered layer is deposited.

In the last several decades, a number of solventless painting processes have been developed in which finely divided, heat-fusible materials are deposited on a substrate and are then fused into continuous functional or decorative film. Representative of these processes are the fluidized bed, the electrostatic spray, and the electrostatic fluidized bed (ESFB).

The present invention relates specifically to electrostatic fluidized beds which, as the name implies, combines certain features of the fluidized bed and the electrostatic deposition processes. More specifically, in the ESFB process, air is introduced into a plenum chamber below the porous distribution plate of a fluidized bed where it passes through a charging medium and is ionized by a corona discharge. The ionized air then passes through the porous plate to fluidize a bed of finely divided coating powder. The ionized charge in the fluidizing gas is transferred to the fluidized particles which, because they all bear a similar charge, form a cloud of charged particles. When a grounded substrate is brought into close proximity with this charged cloud, the coating powder is attracted to and deposited upon the grounded substrate. Subsequent to this deposition, the substrate is heated in a convection oven or by other means to fuse the particles into a continuous film over the contacted area of the substrate.

By way of contrast, in conventional electrostatic spraying processes, the coating powders are charged by blowing them through the nozzle of a spray gun and past the tip of a high-voltage electrode. In a conventional fluidized bed, the fluidizing air is not ionized, and adhesion of the powders is achieved by heating the substrate to the fusion temperature of the coating powders. The substrate is dipped into the bed.

While both ESFB and electrostatic spraying processes are dominated by field charging, there are substantial differences between them. For example, because particles are impelled toward the substrate in electrostatic spraying, there will always be a substantial amount of overspray which, for purposes of economy, must be collected and re-introduced into the system. In the ESFB process, however, because there is no velocity imparted to the particles to carry them beyond the free surface of the fluidized bed, transportation to the substrate is almost exclusively a result of electrostatic forces. Essentially, this means that there is little or no overspray, and non-adhering particles merely fall back into the fluidized bed where they are again charged and immediately made available for redeposition on the substrate.

Because of the pure electrostatic nature of ESFB, the rate of deposition may be faster and the coating thickness may be greater than can be obtained in other electrostatic coating processes. The characteristics of ESFB make it particularly suitable for applying functional coatings of substantial thickness that may be useful, for example, in providing insulation for various electrical devices.

SUMMARY OF THE INVENTION

The object of this invention is to increase the rate of powder deposition (build rate) in ESFB coating processes.

Another object of this invention is to increase the weight of powder deposition (coating thickness) in ESFB coating processes.

Yet another object of this invention is to provide coating powders that will deposit more deeply into holes, slots or other cavities in the substrate.

Briefly, these and other objects of this invention are achieved by limiting the amount of fine particles in the coating powder to certain maximum levels, e.g., no more than 10% by weight smaller than (minus) 38 micrometer particles and, more preferably, no more than 6% by weight of smaller than 27 micrometers, and still, more preferably, no more than 3% by weight of smaller than 19 micrometers, and still, more preferably, no more than 2% by weight of smaller than 13 micrometers, and still, more preferably, no more than 0.5% by weight of smaller than 9.4 micrometers. Preferably, all minus 19 micrometer particles are removed from the powdered material.

BRIEF DESCRIPTION OF THE DRAWINGS

The single FIGURE is a graph of regression analysis curves showing penetration depth of particles into a slot on the ordinate and particle size distribution on the abscissa.

DETAILED DESCRIPTION

Statement of the Closest Prior Art

U.S. Pat. No. 4,154,871 provides a method for increasing the rate of deposition of powders from an ESFB by spherodizing a portion of the powders. The patent teaches that all of the powder particles should be larger than 1 micrometer. Table I of the patent provides data for the particle size distribution of representative powders. This is the only patent reference known to applicants that discloses information about preferred particle sizes for use in for ESFB. Other prior art is based upon actual particle sizes measured for several commercially available ESFB powders and is given in the table included in the Examples that follow:

It is also known in the prior art that the removal of very small fine powders, that is, those less than about 10 micrometers, may produce some advantages, such as reducing a health hazard from airborne dust and improving the free flowing characteristics of the coating powders. To the inventor' knowledge, however, fines larger than 10 micrometers have not been removed from coating powders because there was no advantage in doing so; it would be wasteful to discard the removed particles; and it would add an additional expense to reclaim the powders.

No information in the prior art has been found that teaches limiting the amount of fines in an ESFB coating process to improve the application characteristics of the powders.

EXAMPLE 1

A thermosetting epoxy coating material was prepared by melt blending the following ingredients in a mixing extruder.

| Ingredient | phr* |
|---|---|
| Epoxy resin Bisphenol-A epichlorohydrin type 7, 1650-200 e.e.w. | 30 |
| Epoxy resin - Bisphenol-A epichlorohydrine type 4, 875-1025 e.e.w. | 70 |
| Filler - Silicon Dioxide | 140 |
| Curing Agent - Dicyandiamide type | 3 |
| Pigment - Iron Oxide | 3 |
| Accelerator - 2-methylimidizole | 1 |

*Parts per hundred parts of resin by weight

TABLE I

| Micro-meters | Cumulative Weight % Smaller Than The Given Particle Size A Air Classified | B U.S. Pat. No. 4,154,871 | C Prior Art | D Prior Art |
|---|---|---|---|---|
| 38 | 8.8 | 29.5 | 11.7 | 27.8 |
| 27 | 2.4 | N/A | 9.6 | 21.0 |
| 19 | 0.0 | 22.3 | 7.1 | 13.8 |
| 13 | 0.0 | 3.5 | 3.7 | 8.1 |
| 9.4 | 0.0 | N/A | 2.9 | 4.6 |

The mixture was extruded and immediately cooled before any substantial reaction occurred (i.e., it was still fusable) and it was then ground into a powder using a pin mill. After grinding, the powder was sifted through a 60 mesh screen to remove the coarse particles and then air classified to remove a portion of the fine particles. The size distribution of the particles finer than 38 micrometers is listed in Table I in column A "Air Classified". For comparison purposes, the same values are listed for three prior art ESFB coating powders, including one taken from an example in U.S. Pat. No. 4,154,871 (column B) and two commercially available powders (columns C and D).

The coating powders A, B, C and D, as well as other powders containing differing size distributions of minus 38 micrometer particles were tested for their ability to penetrate into slots, the rate at which the powders deposited and the weight of powder deposition. The test procedures used are as follows:

POWDER DEPOSITION

The rate and weight of deposition were determined using standard coating panels designated in UL 746 B. These panels are generally "U" shaped channels measuring 127 mm in length, 19 mm in width, and legs of 8 mm. The channel is made from metal 2 mm thick.

In the test, the channels were mounted 7.9 cm over the ESFB with the long dimension parallel to the surface of the bed and the channel opening facing the surface of the ESFB.

Deposition weights were measured by weighing the channels before and after coating. The values reported are the average of three tests and were made at the stated charging voltages and charging times.

SLOT PENETRATION

Rectangular slot blocks, such as described in U.S. Pat. No. 4,154,871, were prepared to measure the relative ability of powders to penetrate slots. The blocks over-all were 3.8 cm×5.7 cm×8.9 cm with 5 length-parallel slots separated by 0.394 cm. The dimensions of the slots are as follows:

| Slot | Length | Width | Depth |
|---|---|---|---|
| 1 | 8.9 cm | 1.27 cm | 2.54 cm |
| 2 | 8.9 | 0.95 | 2.54 |
| 3 | 8.9 | 0.635 | 2.54 |
| 4 | 8.9 | 0.32 | 1.91 |
| 5 | 8.9 | 0.16 | 1.27 |

The blocks were mounted 7.9 cm above an ESFB with the lengthwise dimension of the blocks perpendicular to the surface of the ESFB. The distance that the powders penetrated into the slots was measured at various charging voltages and charging times. All tests were repeated three times and the average values reported.

Comparisons were made between the powders to determine the effects of removal of fine particles upon rate and amount of powder deposited in a given time at a fixed charging voltage. For example, at 8 seconds the 40 KV build rate of the "A" powder was 216 mg/sec compared with 110 mg/sec for the "D" powder. Similar improvements were observed in total powder deposited and slot penetration. These results, along with those obtained for prior art powders are presented below:

TABLE II

| Time Exposed to Charged Powder | Rate of Deposition A Air Classified | B Prior Art | C Prior Art | D Prior Art |
|---|---|---|---|---|
| | Powder Deposited at 40 KV | | | |
| 8 sec | 1.73 g | 1.41 g | 0.70 g | 0.88 g |
| 12 sec | 2.55 | 1.58 | 0.92 | 1.08 |
| 15 sec | 2.63 | 1.58 | 1.07 | 1.69 |
| 20 sec | 3.32 | 1.87 | 1.25 | 1.76 |
| 30 sec | 4.16 | 2.56 | 1.93 | 2.32 |

TABLE III

| | Depth of Slot Penetration Powder A Air Classified | B Prior Art | C Prior Art | D Prior Art |
|---|---|---|---|---|
| | Slot Penetration at 60 KV/12 sec. | | | |
| Slot 1 | 53.3 mm | 33.7 mm | 20.7 mm | 18.0 mm |
| Slot 2 | 49.0 | 34.3 | 17.3 | 17.5 |
| Slot 3 | 48.3 | 30.7 | 17.0 | 13.3 |
| Slot 4 | 40.3 | 25.0 | 14.3 | 11.5 |
| Slot 5 | 35.0 | 20.0 | 11.0 | 8.8 |

These data clearly show that the depth of slot penetration and the rate at which powders are deposited are significantly increased with decreasing amounts of minus 38 micrometer particles in the coating powders.

EXAMPLE 2

A powder was prepared and ground in accordance with Example 1 and then air classified into a fine fraction and a coarse fraction. Particle size analysis by a commercially available light scattering instrument produced the following distributions, presented as cumulative % smaller than the given micrometer particle size:

| Micrometers | Starting Material | Coarse Fraction | Fine Fraction |
|---|---|---|---|
| 212 | 99.3% | 99.6% | 100.0% |
| 150 | 90.7 | 92.2 | 100.0 |
| 106 | 67.4 | 72.0 | 100.0 |

-continued

| Micrometers | Starting Material | Coarse Fraction | Fine Fraction |
|---|---|---|---|
| 75 | 50.1 | 48.0 | 98.4 |
| 53 | 39.8 | 27.5 | 96.4 |
| 38 | 30.1 | 15.6 | 87.5 |
| 27 | 25.1 | 8.6 | 70.9 |
| 19 | 20.1 | 2.2 | 50.6 |
| 13 | 14.7 | 0.7 | 32.3 |
| 9.4 | 9.7 | 0.0 | 19.1 |
| 6.6 | 4.8 | 0.0 | 9.7 |
| 4.7 | 2.1 | 0.0 | 4.4 |
| 3.3 | 1.2 | 0.0 | 0.0 |

The fine fraction was added incrementally to the coarse fraction until all of the fines had been recombined with the coarse fraction. This produced a wide range of size distributions for evaluation. (The starting particle size distribution was not exactly duplicated by this recombination due to changes resulting from the classification process, e.g., the complete loss of minus 3.3 micrometer particles.)

The coarse fraction and each subsequent addition mixture were evaluated for slot penetration by the previously described procedure. Table V lists the resulting particle size distributions, so produced, as well as penetration into the middle (third) slot of the slot block, which was judged most representative. In addition, the coarse fraction was further modified by screening(E) to remove additional fines. Sample G was also included to show the change in distribution which resulted from the mixing operation along and the corresponding slot penetration of these samples.

TABLE IV

| Sample Identification | Source |
|---|---|
| E | Screened coarse |
| F | Coarse fraction |
| G | Coarse + 0% fines |
| H | Coarse + 2% fines |
| I | Coarse + 5% fines |
| J | Coarse + 8% fines |
| K | Coarse + 12% fines |
| L | Coarse + 16% fines |
| M | Coarse + 20% fines |
| N | Starting powder |

ented in the preceding examples, may result in some increased benefits.

The data in Table V was thus subjected to a regression analysis in which the depth of slot penetration was compared to the amount of fines at particular sizes present in the coating powders. Regression lines were plotted for each measured micrometer size in the range 9.4 to 75 using a power function which provided the most acceptable least squares fit. This analysis is graphically shown by the several curves of the FIGURE.

The tabulated values in Table V are the cumulative percentages of all sizes present in the powders below the ranges reported by the measuring instrumentation. Thus, for sample E the weight of minus 38 micrometer particles is 4.4%, the weight of minus 27 micrometer particles is 3.0% and the weight of minus 19 micrometer particles is 0%.

The FIGURE illustrates the improvement in slot penetration as the particles below a given size are removed. For example, a powder (M) having 14% by weight of its particle size distribution smaller than 27 micrometers was found to penetrate 17 mm while a powder (H) with 5% by weight of its particle size distribution smaller than 27 microns penetrated 28 mm.

The FIGURE also illustrates, for example, that to achieve 25 mm of penetration with the test specimens and under the test conditions, the ESFB must contain less than 5% of minus 9.4 micrometer particles, less than 2% of minus 13 micrometer particles, less than 3% of minus 19 micrometer particles, less than 6% minus 27 micrometer particles, less than 9% minus 38 micrometer particles and less than 15% minus 53 micrometer particles.

The FIGURE also shows that effects of the removal of particles less than 75 micrometers, for example, are not linear. Surprisingly, the regions in the family of curves of variance from linearity becomes much more pronounced with decreasing sizes of fines.

We claim:

1. A method of forming a film on surfaces of a substrate, the method comprising providing a flow of gaseous medium, providing a bed of powdered material and fluidizing the same with said flow of gaseous medium, imparting a charge to said powdered material,

TABLE V

| Micrometers | Powder E | F | G | H | I | J | K | L | M | N |
|---|---|---|---|---|---|---|---|---|---|---|
| 212 | 99.7% | 99.6% | 99.4% | 99.5% | 99.5% | 99.5% | 99.4% | 99.4% | 99.4% | 99.3% |
| 150 | 82.3 | 92.2 | 87.4 | 89.2 | 86.8 | 89.4 | 88.7 | 90.2 | 88.8 | 90.7 |
| 106 | 51.0 | 72.0 | 57.8 | 63.7 | 56.3 | 60.7 | 62.6 | 62.6 | 64.0 | 67.4 |
| 75 | 31.5 | 48.0 | 38.3 | 39.3 | 42.7 | 41.3 | 40.8 | 43.0 | 47.5 | 50.1 |
| 53 | 15.4 | 27.5 | 25.8 | 27.5 | 31.4 | 30.3 | 27.9 | 33.8 | 36.0 | 39.8 |
| 38 | 4.4 | 15.6 | 13.6 | 14.5 | 14.9 | 15.0 | 17.9 | 19.7 | 24.2 | 30.1 |
| 27 | 3.0 | 8.6 | 5.6 | 7.5 | 9.2 | 10.4 | 13.3 | 14.4 | 18.6 | 25.1 |
| 19 | 0.0 | 2.2 | 3.3 | 4.6 | 6.1 | 6.1 | 7.6 | 9.9 | 14.1 | 20.1 |
| 13 | 0.0 | 0.7 | 2.8 | 0.7 | 5.7 | 2.3 | 4.9 | 7.4 | 10.4 | 14.7 |
| 9.4 | 0.0 | 0.0 | 0.0 | 0.0 | 1.6 | 2.3 | 2.3 | 5.1 | 4.7 | 9.7 |
| 6.6 | 0.0 | 0.0 | 0.0 | 0.0 | 0.5 | 2.3 | 0.5 | 0.9 | 2.1 | 4.8 |
| 4.7 | 0.0 | 0.0 | 0.0 | 0.0 | 0.5 | 1.5 | 0.0 | 0.6 | 1.2 | 2.1 |
| 3.3 | 0.0 | 0.0 | 0.0 | 0.0 | 0.0 | 0.0 | 0.0 | 0.6 | 0.0 | 1.2 |
| | Slot Penetration | | | | | | | | | |
| mm | 39.3 | 35.3 | 27.0 | 28.3 | 25.0 | 23.7 | 19.3 | 19.3 | 16.7 | 16.0 |

The data given in Table V clearly indicates that the variations in the particle size distributions were accompanied by similar variations in the depth of slot penetration. The progressive nature of the data suggests that increased fines removal, even beyond the degree presdisposing the substrate in the proximity of said fluidized bed, whereupon charged powder deposits upon surfaces of the substrate, and fusing said deposited powder to form a film;

the improvement comprising limiting the minus 38 micrometer particles to 10% by weight or less of said powdered material.

2. A method of forming a film on surfaces of a substrate, the method comprising providing a flow of gaseous medium, providing a bed of powdered material and fluidizing the same with said flow of gaseous medium, imparting a charge to said powdered material, disposing the substrate in the proximity of said fluidized bed, whereupon charged powder deposits upon surfaces of the substrate, and fusing said deposited powder to form a film;

the improvement comprising removing all minus 19 micrometer particles from said powdered material.

3. A method of forming a film on surfaces of a substrate, the method comprising providing a flow of gaseous medium, providing a bed of powdered material and fluidizing the same with said flow of gaseous medium, imparting a charge to said powdered material, disposing the substrate in the proximity of said fluidized bed, whereupon charged powder deposits upon surfaces of the substrate, and fusing said deposited powder to form a film;

the improvement comprising limiting the minus 38 micrometer particles to 10% by weight or less of said powdered material, the minus 27 micrometer particles to 6% by weight or less, the minus 19 micrometer particles to 3% by weight or less, the minus 13 micrometer particles to 2% by weight or less and the minus 9.4 micrometer particles to 0.5% by weight or less.

* * * * *

UNITED STATES PATENT AND TRADEMARK OFFICE

CERTIFICATE OF CORRECTION

PATENT NO. : 4,689,241

DATED : Aug. 25, 1987

INVENTOR(S) : Douglas S. Richart et al.

It is certified that error appears in the above-identified patent and that said Letters Patent is hereby corrected as shown below:

Column 1, line 45, insert before substrate -- hot --.

Column 6, line 28, substitute -- 1% -- for "5%".

Signed and Sealed this

Fourteenth Day of May, 1991

*Attest:*

*Attesting Officer*

HARRY F. MANBECK, JR.

*Commissioner of Patents and Trademarks*